United States Patent [19]

Maeda

[11] 4,064,661

[45] Dec. 27, 1977

[54] CENTRIFUGAL BLASTING APPARATUS

[76] Inventor: Riichi Maeda, 30-1, Kitakata 2 chome, Ichikawa, Chiba, 272, Japan

[21] Appl. No.: 677,785

[22] Filed: Apr. 16, 1976

[30] Foreign Application Priority Data

Apr. 19, 1975 Japan ..... 50-47849

[51] Int. Cl.[2] ..... B24C 5/06

[52] U.S. Cl. .....51/424; 51/434; 51/435

[58] Field of Search ..... 51/8 BR, 8 SR, 9 R, 51/9 M, 435, 434, 424; 239/224

[56] References Cited

U.S. PATENT DOCUMENTS

| | | | |
|---|---|---|---|
| 731,463 | 6/1903 | Jones | 51/9 R |
| 2,628,456 | 2/1953 | Berg | 51/8 BR X |
| 3,111,173 | 11/1963 | Klonoski | 239/224 X |
| 3,405,481 | 10/1968 | Harper | 51/9 R |
| 3,900,969 | 8/1975 | Diehn | 51/9 M |
| 3,916,568 | 11/1975 | Rose | 51/9 M X |

*Primary Examiner*—Gary L. Smith
*Attorney, Agent, or Firm*—Cushman, Darby & Cushman

[57] ABSTRACT

A centrifugal blasting apparatus with a spindle arranged vertically, a boss fixed to the spindle, and a plurality of vanes provided circumferentially on the boss. The vanes are slanting with respect to the axis of rotation and an axis perpendicular to the axis of rotation. The apparatus throws abrasive particles in the axial direction permitting minimal size.

9 Claims, 6 Drawing Figures

CENTRIFUGAL BLASTING APPARATUS

BACKGROUND OF THE INVENTION

The present invention is concerned with an abrading equipment, and more particularly it relates to a centrifugal blasting apparatus in the abrading equipment.

SUMMARY OF THE INVENTION

A primary object of the present invention is to provide a centrifugal blasting apparatus which can be made small in size and light in weight and which can produce blast streams at substantially the same angle with respect to the surface of a workpiece in spite of its much widened blast pattern.

An object of the present invention is to provide a fundamentally novel centrifugal blasting apparatus.

The present invention also intends to provide a centrifugal blasting apparatus which can collect blasted abrasive particles to permit them to circulate within the apparatus.

A centrifugal blasting apparatus according to the present invention essentially comprises a blast wheel having an axis of rotation circumferentially provided with vanes. It supplies abrasive particles on the surface of the vanes from the upper portion of the vanes, moves and propels them on the surface of the vanes and then centrifugally throws them the lower portion of the vanes.

The vanes are generally curved forward with respect to the direction of rotation of the blast wheel. They are so-called forward curved vanes as termed in the industry of turbine or blower. The vane per se may be constituted by a curved surface or a plane surface. In the case of a curved surface, the outside diameter of the blast wheel can be made smaller. In the case of a plane surface, the blast wheel can be fabricated more easily.

The arrangement of the vanes are as follows: If the vanes are each constituted by a curved surface, each of the vanes has a curved suface extending and being curved along the geometrical median line of the vane and also has a curved surface extending and being curved in the direction perpendicular to the median line. The tangent plane at any point lying on the median line is slanting at the same angle with respect to the axis of rotation. In principle, the vane is constructed so that those tangent planes at points lying on the median line in the upper portion of the vane form an acute angle with the axis perpendicular to the axis of rotation, that those tangent planes at points lying on the median line in the lower portion of the vane form an obtuse, i.e. a negative acute angle with the same, and that the tangent plane at the middle point of the vane contains the axis perpendicular to the axis of rotation. In some cases, the vane is constructed so that the tangent plane at a point located in the upper portion of the vane contains the axis perpendicular to the axis of rotation and that the angle formed between the tangent plane and the perpendicular axis becomes greater as it goes towards the lower portion of the vane.

If the vanes are each constituted by a plane surface, they are defined more clearly. Each of the vanes is arranged to lie in a plane which is slanting with respect to the axis of rotation and also with respect to the axis perpendicular to the axis of rotation.

In either cases, the angle of the vane is determined by experiment, but in the case of the vane constituted by a plane surface, the following angles have been obtained as standards because of less factors to be taken into consideration. That is to say, the angle with respect to the axis of rotation is between 25° an 65°, and the angle with respect to the perpendicular axis is between 40° and 80°.

In a blasting apparatus having a blast wheel with the vanes as described above, abrasive particles are supplied at the top of the vanes. The abrasive particles are moved and propelled on the surface of the vanes due to the rotation of the blast wheel and then are thrown from the bottom of the vanes in a resultant direction of the acceleration and the rotation speed.

The blast pattern of the thrown abrasive particles is circular and the blasting angle of the particles thrown by this blast wheel can be said 360°. Although the angles and directions of the blast streams are not completely identical, they are practically considered identical. As a result, it is possible to place a workpiece close to the blast wheel and to use very fine abrasive particles.

The blast wheel as described above make it possible to provide a centrifugal blasting apparatus within which the blasted abrasive particles can be collected and circulated. As a result, there is obtained a blasting apparatus compact in size and excellent in operability.

The above and other objects and features of the present invention will become apparent from the following detailed description as well as the accompanying drawings.

BRIEF DESCRIPTION OF THE DRAWINGS

FIG. 1 is a vertical sectional view, with a part omitted, of the blasting apparatus.

FIG. 2 is a bottom view of the blasting apparatus seen from line II—II in FIG. 1.

FIG. 3 illustrates the form of a vane in the blasting apparatus, only one vane being shown for simplicity with the others omitted.

FIG. 4 is a vertical sectional view, with a part omitted, of the blasting apparatus.

FIG. 5 is a perspective view showing only the blast wheel with a part broken.

FIG. 6 illustrates the form of a vane in the blasting apparatus, only one vane being shown for simplicity with the others omitted.

DESCRIPTION OF THE PREFERRED EMBODIMENTS

Figure 1:
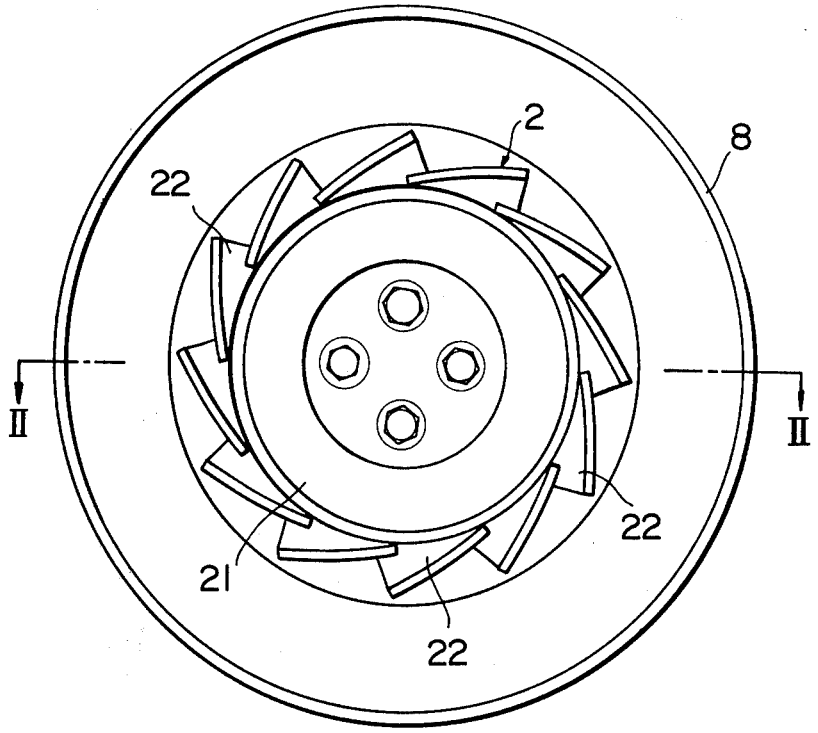
FIGS. 1 to 3 show a preferred embodiment of a centrifugal blasting apparatus having the most simple construction according to the present invention.
Figure 2:
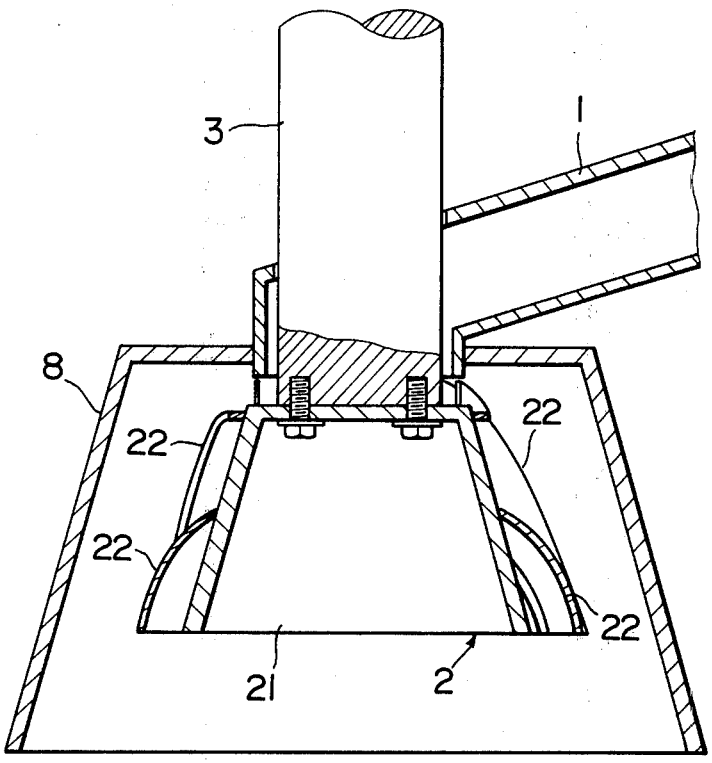

FIGS. 1 and 2 show the most simply constructed blasting apparatus according to the present invention. The blasting apparatus comprises a chute 1 connected to an abrasive tank (not shown), a rotatable spindle 3 supporting a blast wheel 2 and vanes for centrifugal blasting.

The blast wheel 2 is fixed, by screws, to an end of the spindle 3 provided vertically in the apparatus and is housed in a housing 8. The spindle 3 is rotatably supported in the apparatus by appropriate bearing means and the opposite end thereof is connected to an electric motor via such gearing means as pulleys and belt. The chute 1 is connected to an abrasive tank at an end and so extends as to be positioned over the top of the blast wheel at the other end. The spindle 3 extends through the other end portion of the chute 1 with a gap formed between the spindle 3 and the other end portion of the chute 1. Abrasive particles are supplied from the tank via the chute 1 and permitted to spontaneously drop through the gap onto the top of the blast wheel 2.

The blast wheel 2 comprises a frusto-conical boss 21 and a plurality of vanes 22 arranged circumferentially on the boss 2 in an equally spaced relation from each other. In this embodiment, the surface 23 of each of the vanes 22 is constituted by two curved surfaces which are curved along the periphery of the side surface of the boss 21 and along the generating line of the side surface of the boss 21, respectively. The abrasive particles come into the blast wheel 2 from the upper end thereof and are moved on the curved surfaces 23 of the vanes 22 to be centrifugally thrown from the lower ends of the vanes 22 toward a workpiece. As will be understood from the foregoing description, prior centrifugal blasting apparatus is of radial flow type while the centrifugal blasting apparatus according to the present invention is of axial flow type.

Figure 3:
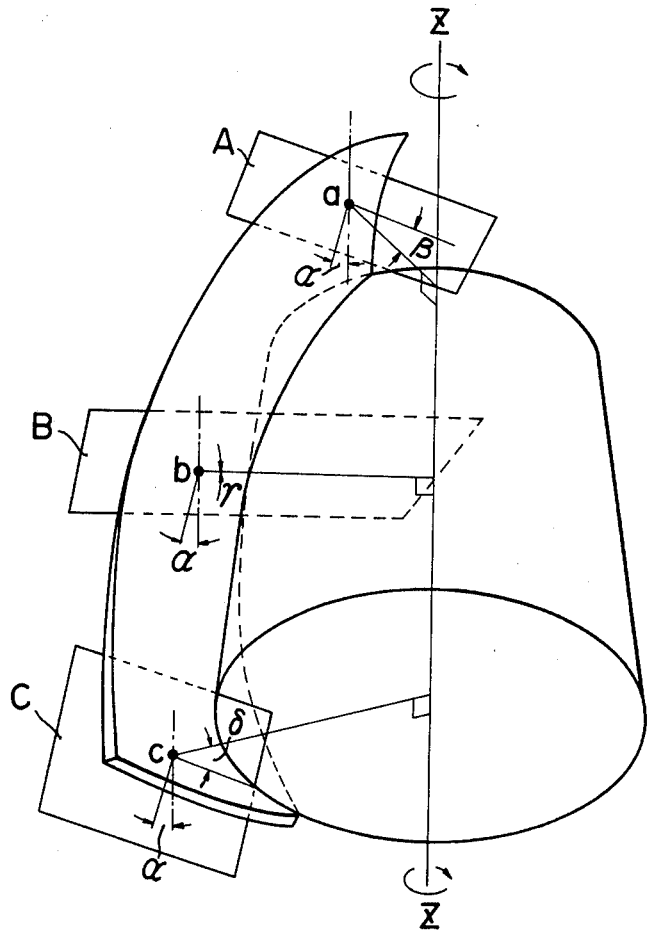

Referring to FIG. 3, description will be directed particularly to the form of the vanes 22. The vanes are arranged around the axis of rotation Z of the spindle 3 with equal spaces between each other. The tangent plane A to the surface 23 of the vane at a point *a* lying on the geometrical median line of the surface 23 in the vicinity of the upper end of the vane forms an acute angle $\alpha$ to the axis Z. Similarly, the tangent planes B and C which are positioned at a point *b* in the vicinity of the center of the vane and a point *c* in the vicinity of the lower end of the vane make the acute angle $\alpha$ to the axis Z. The tangent plane A makes an angle $\beta$ with a perpendicular from the point *a* to the axis Z. The tangent planes B and C form angles $\gamma$ and $\delta$ to perpendiculars from the points *b* and *c* to the axis Z, respectively.

These angles $\alpha$, $\beta$, $\gamma$ and $\delta$ are determined by experiment and trial manufacture. In principle, the angle $\alpha$ is adapted to be acute and the angles $\beta$ and $\delta$ are adapted to be acute in the opposite directions, that is, the angle $\delta$ is obtuse or acute when measured in the negative direction. The angle $\gamma$ is adapted to be substantially zero. In case the abrasive particles have great velocity in the centrifugal direction so that they undesirably tend to be thrown from the side edges of the vanes, it is desirable to arrange the angle $\beta$ to be zero and the angles $\gamma$ and $\delta$ to become greater towards the lower end of the vane.

As stated previously, the abrasive particles are supplied to the blast wheel 2 via the chute 1, and they are accelerated on the vane surface due to the rotation of the blast wheel and thrown toward a workpiece from the lower end edges of vanes. More specifically, the abrasive particles are fed from the top of the vanes onto the surface. Then, they are accelerated on the surface in the centrifugal direction by the centrifugal force produced by the rotation of the blast wheel. At the same time, they are also accelerated in the direction toward the lower end of the vane due to the curvature of the vane surface. As a result, the abrasive particles are moved, while accelerated, on the vane surface from the upper end thereof to the lower end and thrown from the lower end edge of the vane in the resultant direction of the two directions as described above onto a workpiece. They are simultaneously blasted from all of the vanes, and the resulting blasted pattern is circular. More precisely, the blasted pattern is of a ring-shape because the abrasives are not thrown from the boss 21.

According to the present invention, the vane surface may be constituted by a plane surface. Such vanes tends to make the outside diameter of the blast wheel greater as compared with the curved-surfaced vanes, but they advantageously makes fabrication and inspection simpler and production cost lower.

Figure 4:
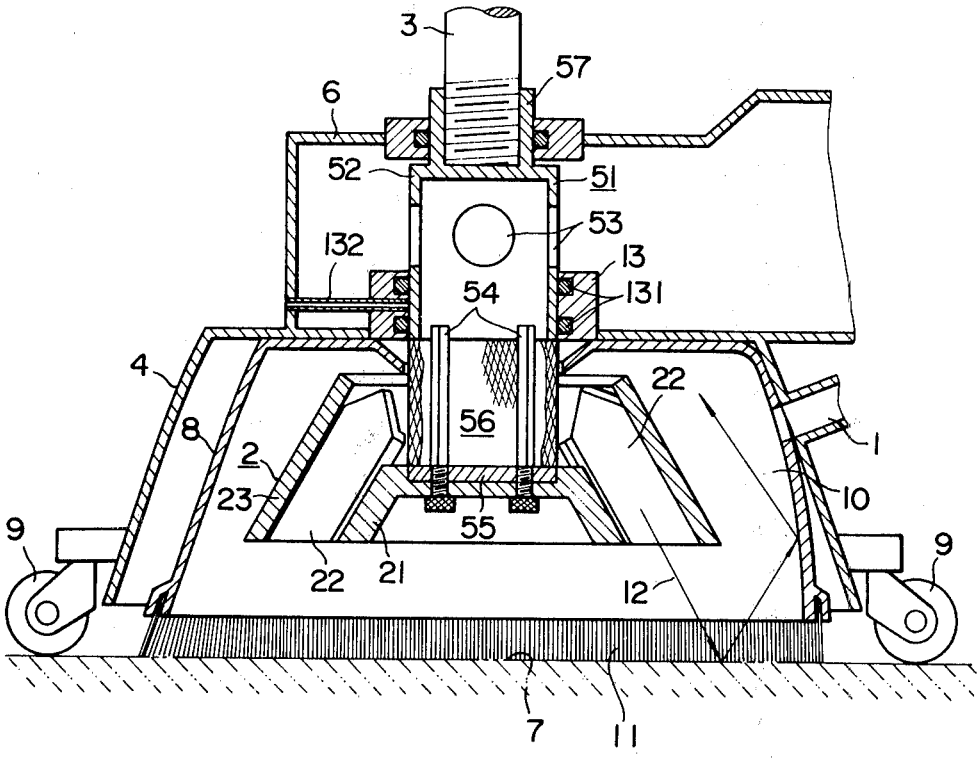
FIGS. 4 to 6 show a preferred embodiment of a more practical centrifugal blasting apparatus according to the present invention.
Figure 5:
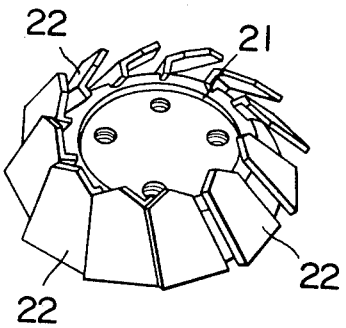
Figure 6:
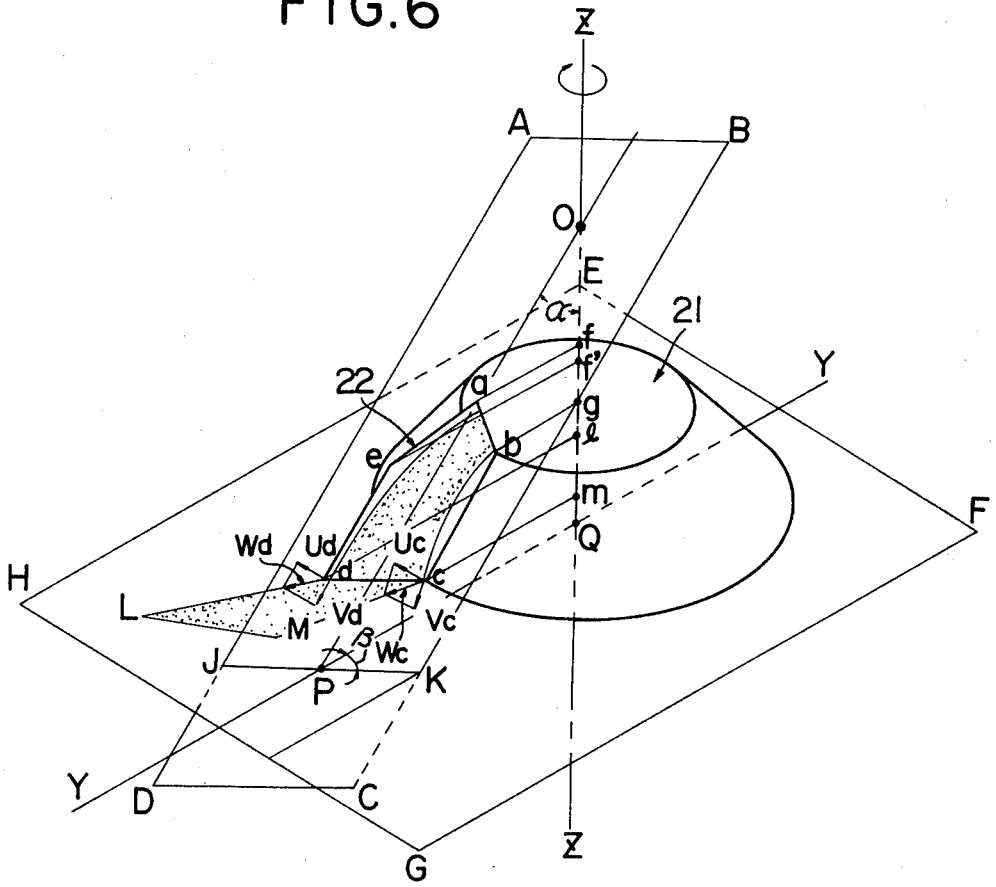

FIGS. 4 to 6 show another preferred embodiment in which the vanes have surfaces each constituted by a plane surface. In this embodiment, the blasting apparatus is provided with means for collecting the abrasive particles blasted onto a workpiece in the apparatus and circulating them for repetitive utilization.

The blast wheel 2 comprises a frusto-conical boss 21 and a plurality of vanes 22 arranged circumferentially on the boss 22. The blast wheel 2 further has a cover 23. The vanes are fixed to the boss and the cover at the opposite ends thereof. Each of the vanes is greater than the boss in height and has an end edge encircling the top of the boss.

Each of the vanes has the form as shown in FIG. 6. More specifically, each of the vanes is formed so that it lies in a plane ABCD which make an angle $\alpha$ to the axis of rotation Z, an angle $\beta$ to a line Y perpendicular to the axis Z. As in the case of the curvedly-surfaced vane, the angles $\alpha$ and $\beta$ are determined by experiment. However, since factors to be considered are simpler as compared with the curvedly-surfaced vane, the angles listed below have been found and considered as guides. These guides would save following researchers random experiments.

Angle $\alpha = 45° \pm 20°$

Angle $\beta = 60° \pm 20°$

Referring particularly to FIG. 6, the dimensions of the preferred blast wheel as tested by the inventor will be hereinafter described. They would be of help to future researchers.

In FIG. 6, the plane EFGH shows a plane in which a workpiece lies. The axis Y indicates an axis lying in the plane EFGH and perpendicularly crossing with the axis of rotation Z at a point Q. The plane ABCD designates a plane crossing with the axis Z at an angle of $\beta$ and with the axis Y at an angle of $\alpha$ in which the vane abcde lies. The line JK shows a crossing line of the planes ABCD and EFGH. The points *f*, *g*, *l* and *m* indicate the foots of the perpendiculars from the points *a*, *b*, *d* and *c* to the axis (Z), respectively. The point *f'* designates the foot of the perpendicular from the point *e* to the axis (Z) and is to be located between the points *f* and *g*. The plane LMdc means the stream of abrasive particles blasted from the vane abcde. The line OP shows the median line of the plane ABCD. Ud means the rotation speed of the abrasive particles arriving at the outermost end of the vane and V*d* menas the acceleration speed of the same abrasive particles. W*d* is the resultant speed of U*d* and V*d* and indicates the direction of blasting. U*c*, V*c* and W*c* mean the corresponding speeds to U*d*, V*d* and W*d* when the particle reaches the innermost end of the vane.

In FIG. 6, $\alpha = 45°$, $\beta = 60°$, $ef' = 82$mm, $af = 65$mm, $bg = 65$mm, $dl = 127$mm, $cm = 108$mm, $fg = 13$mm, $gl = 51$mm, and $lm = 17$mm. The area covered with abrasive particles blasted by the blast wheel having the above-mentioned dimensions are generally of a ring-shape in which $mQ = 32$mm, $MQ = 116$mm, and $LQ = 165$mm. The average blasting velocity of abrasive particles is 50 m/sec when the blast wheel is rotated at 7300 r.p.m. The quantity of the blasted abrasive particles amounts approximately to 375 Kg/min. when the blast wheel is driven at 50 ps.

The vanes are fixed to the boss and the cover by welding or by means of grooves and mating projections.

As previously described, abrasive-circulating means can effects collecting and re-utilizing blasted abrasive particles within the blasting apparatus to improve operability of the apparatus and reduce the size of the apparatus.

The abrasive-circulating means 5 includes an air ducting cylinder 51 provided between the blast wheel 2, and the spindle 3. The air ducting cylinder 51 has a hollow cylindrical portion 52 connected with the spindle 3 and a mounting plate 55 for mounting the blast wheel, as shown in FIG. 4. Supporting pillars 54 are suspended from the cylindrical portion 52 in a spaced relation with each other and supports the mounting plate 55 at their lower ends. The cylindrical portion 52 is provided with openings 53 through the circumferential wall thereof and is positioned such that the openings 53 are located in a suction duct 6 and that the supporting pillars encircle the center of the blast wheel. The suction duct is connected, at one end, with a known suction pump (not shown).

A housing 8 is provided to house the cover 23 of the blast wheel. A passage 10 is defined between the inner wall of the housing 8 and the outer wall of the cover 23. The lower end of the housing 8 is provided with a sealing brush means 11 which contacts the surface of a workpiece to seal the interior of the housing 8 from the open air to a degree when the blasting apparatus is placed on the workpiece. The passage 10 leads to an air ducting passage extending between the supporting pillars 54, between the cylindrical portion 52 and the mounting plate 55, through the hollow of the cylindrical portion 52 and through the openings 53 to the suction duct 6. When the suction pump is operated, the open air is coercively sucked through the brush means and these passages.

The abrasive feeding chute 1 penetrates the housing 8 and a casing 4 provided outside the housing 8 and opens into the passage 10 at one end. The other end of the chute 1 is connected to a known abrasive tank (not shown). Abrasive particles are fed from the tank to the top portion of the vanes of the blast wheel 2 by the air flow caused by the air suction. A wire net 56 which has meshes smaller than the diameter of the abrasive particles is provided to surround the supporting pillars 54 of the air ducting cylinder 51 in order to feed only the abrasive particles. The abrasive particles are struck against the wire net 56 and dropped onto the top ends of the respective vanes. Then, they are moved and propelled on the vane surfaces and blasted from the lower ends of the vanes onto a workpiece 7. The blasted particles hit against the workpiece and rebounded from. Then, the particles are wafted by the air flow and carried to the top ends of the vanes again. Thus, the circulation of the abrasive particles is effected within the blasting apparatus, as shown by the arrow 12.

To effectively carry the abrasive particles on the air flow, the inner surface of the housing 8 is given such an inclination as to allow the particles which have rebounded from the workpiece surface to advantageously move toward the top portion of the blast wheel. The abrasive particles which have rebounded from the workpiece surface are struck against the inner surface of the housing. At the time of striking, the speed of the abrasive particles is much reduced so that they are carried on the air flow. Due to the arrangement for guiding the abrasive particles as described above, most of the particles blasted can be circulated.

The abrasive particles hardly stick to the wire net 56, because the net is rotated at high speed.

The casing 4 is integral with the suction duct 6 and constitutes a frame structure of the blasting apparatus together with the duct 6. The air ducting cylinder 51 with the aforesaid arrangement is placed to penetrate the duct 6 and sealed with upper and lower sealing means. The lower sealing means 13 is arranged in the vicinity of the housing 8 to prevent the abrasive particles from entering the duct 6. More specifically, the lower sealing means has a pair of O-rings 131 positioned in a holder in a spaced relation from each other. Between the pair of O-rings 131 provided is a pipe 132 which communicates with the outside air. When the air suction is effected, the outside air flows in the pipe 132 to produce an air flow which goes towards the respective O-rings 131, thus preventing the abrasive particles from entering the gap between the lower sealing means and the air ducting cylinder while ensuring the high speed rotation of the blast wheel.

The casing 4 is provided with casters 9 at the lower end thereof to support the blasting apparatus and maintain the distance between the blasting wheel and the workpiece constant.

What is claimed is:

1. A centrifugal blasting apparatus comprising:

a spindle mounted vertically in the apparatus;

a blast wheel having an axis of rotation coinciding with the spindle for rotating with the spindle to blast abrasive particles toward a workpiece; and means for supplying the blast wheel with the abrasive particles;

said blast wheel comprising a boss and a plurality of vanes fixed to the boss and arranged around the axis of rotation in an equally spaced relation from each other, the vanes each lying in a plane slanting with respect to the axis of rotation at an angle ranging between 25° and 65°, and with respect to an axis perpendicular to the axis of rotation, at an angle ranging between 40° and 80°, the abrasive particles being fed to the top portion of the blast wheel.

2. An apparatus as in claim 1, further including:

an air ducting hollow cylinder having an axis of rotation coinciding with the axis of rotation of the blast wheel;

a cover provided around the vanes of the blast wheel;

a housing provided in a spaced relation from the cover;

a suction duct enclosing a portion of the air ducting cylinder and being connected with a suction pump;

a first opening provided through a portion of the air ducting cylinder in the vicinity of the vanes of the blast wheel;

a second opening provided through another portion of the air ducting cylinder in the suction duct; and a wire net covering the first opening;

whereby to produce an air flow passing through a passage extending from the space between the cover and the housing via the first opening, the interior of the air ducting cylinder and the second opening to the suction duct when air suction is effected by the suction pump.

3. An apparatus according to claim 2 in which the inner surface of the housing is given an inclination associated with rebounding angle of the abrasive particles at the surface of a workpiece and with the passage, thereby allowing the particles to be effectively carried on the air flow.

4. An apparatus according to claim 3 further comprising sealing means for partially sealing said housing while allowing air to partially pass therethrough.

5. Apparatus according to claim 2 in which sealing means are provided between the suction duct and the air ducting cylinder, one of sealing means being arranged in the vicinity of the blast wheel and having a plurality of sealing members spaced from each other and further being provided, between the sealing members, with a passage for permitting entrance of outside air.

6. An apparatus according to claim 4 in which said partially sealing means is comprised of brushes.

7. An apparatus according to claim 5 in which said sealing members are comprised of O-rings.

8. A centrifugal blasting apparatus comprising:

a spindle mounted vertically in the apparatus;

a blast wheel having an axis of rotation coinciding with the spindle for rotating with the spindle to blasting abrasive particles toward a workpiece; and a chute for supplying the blast wheel with abrasive particles;

said blast wheel comprising a boss fixed to the spindle and a plurality of vanes fixed to the boss and arranged around the axis of rotation in an equally spaced relation from each other, the vanes each being curved in the forward direction of rotation of the blast wheel as they go from the lower portion of the boss toward the upper portion of the boss, the vanes being formed such that tangent planes at any point on the geometrical median line of representative vanes make substantially the same angle, and said vanes being further formed so that those tangent planes at points on the upper portion of the median line of the respective vanes make an acute angle with an axis perpendicular to the axis of rotation, the tangent planes at points on the lower portion of the median line of the respective vanes make an acute angle with the axis perpendicular to the axis of rotation when measured in the reverse direction and the tangent plane at the middle point of the median line of the respective vanes cross substantially at 0° with the axis being perpendicular to the axis of rotation.

9. A centrifugal blasting apparatus according to claim 1 in which angles formed by said tangent planes and an axis perpendicular to the axis of rotation are substantially equal to 0° at the upper portion of the median line of the respective vanes and become greater as they goes toward the lower portion of the median line.

* * * * *